US011730651B2

(12) United States Patent
Gordon et al.

(10) Patent No.: US 11,730,651 B2
(45) Date of Patent: Aug. 22, 2023

(54) MOTION RESTRICTION DEVICE

(71) Applicant: Greater Glasgow Healthboard, Glasgow (GB)

(72) Inventors: Jonathan James Gordon, Glasgow (GB); Kevin James Thomson, Glasgow (GB)

(73) Assignee: Greater Glasgow Healthboard, Glasgow (GB)

( * ) Notice: Subject to any disclaimer, the term of this patent is extended or adjusted under 35 U.S.C. 154(b) by 300 days.

(21) Appl. No.: 17/291,705

(22) PCT Filed: Nov. 6, 2019

(86) PCT No.: PCT/GB2019/053142
§ 371 (c)(1),
(2) Date: May 6, 2021

(87) PCT Pub. No.: WO2020/095045
PCT Pub. Date: May 14, 2020

(65) Prior Publication Data

US 2022/0000689 A1 Jan. 6, 2022

(30) Foreign Application Priority Data

Nov. 7, 2018 (GB) ..... 1818169

(51) Int. Cl.
*A61G 7/07* (2006.01)
*A61G 1/044* (2006.01)
*A61G 1/04* (2006.01)

(52) U.S. Cl.
CPC ..... *A61G 7/072* (2013.01); *A61G 1/044* (2013.01); *A61G 1/04* (2013.01); *A61G 7/07* (2013.01)

(58) Field of Classification Search
CPC ..... A61G 7/072; A61G 7/07; A61G 1/044; A61G 1/04; A47C 7/383; A47C 7/38
(Continued)

(56) References Cited

U.S. PATENT DOCUMENTS 2,205,741 A * 6/1940 Bowers ..... A42B 3/145 2/418
2,205,742 A * 6/1940 Bowers ..... A42B 3/145 2/418

(Continued)

FOREIGN PATENT DOCUMENTS

EP 3228284 10/2017
EP 3876889 B1 * 3/2023 ..... A61F 5/05883

(Continued)

OTHER PUBLICATIONS

International Search Report and Written Opinion issued in PCT/GB2019/053142, mailed Feb. 21, 2020.

*Primary Examiner* — Robert G Santos
(74) *Attorney, Agent, or Firm* — Bell & Manning, LLC

(57) ABSTRACT

There is disclosed a patient restraint assembly including a head restraint configured to extend around the patient's head, at least one securement member (4) extending from the first end of the head restraint, and at least one securement member (5) extending from the second end of the head restraint, said securement members (4, 5) being configured to releasably secure said head restraint to a support table, an adjustment unit (15) to adjust the tension in the securement member(s) (4, 5), wherein adjustment of the adjustment unit (15) applies the same force simultaneously to the securement member(s) (4) at the first end and the securement member(s) (5) at the second end of the head restraint.

19 Claims, 15 Drawing Sheets

(58) Field of Classification Search
USPC ..... 5/637, 636, 622
See application file for complete search history.

(56) References Cited

U.S. PATENT DOCUMENTS

| | | | | | |
|---|---|---|---|---|---|
| 2,926,406 | A * | 3/1960 | Edwards et al. | A42B 3/145 | 2/418 |
| 3,214,809 | A * | 11/1965 | Edwards | A61F 9/06 | 2/418 |
| 3,650,523 | A * | 3/1972 | Darby, Jr. | A61F 5/3707 | 5/624 |
| 3,737,923 | A * | 6/1973 | Prolo | A61F 5/05883 | 5/628 |
| 4,034,748 | A | 7/1977 | Winner | | |
| 4,182,322 | A | 1/1980 | Miller | | |
| 4,267,830 | A | 5/1981 | Vick | | |
| 4,794,656 | A * | 1/1989 | Henley, Jr. | A61G 1/01 | 5/628 |
| 5,265,625 | A * | 11/1993 | Bodman | A61B 6/0421 | 128/870 |
| 5,950,245 | A * | 9/1999 | Binduga | A42B 3/145 | 24/68 B |
| 6,637,057 | B2 * | 10/2003 | Phillips | A61F 5/055 | 5/628 |
| 7,120,954 | B2 * | 10/2006 | Traut | A61F 5/05883 | 5/628 |
| 8,370,967 | B2 * | 2/2013 | Chen | A42B 3/145 | 2/418 |
| 8,707,486 | B2 * | 4/2014 | Chella | A61G 13/125 | 5/624 |
| 9,161,588 | B2 * | 10/2015 | Chen | A42B 3/324 | |
| 9,532,626 | B2 * | 1/2017 | Lovett | A43C 15/061 | |
| 9,629,417 | B2 * | 4/2017 | Cavanagh | A43C 11/165 | |
| 9,737,115 | B2 * | 8/2017 | Soderberg | A43C 1/06 | |
| 9,918,516 | B1 * | 3/2018 | Hall | A43C 11/008 | |
| 10,039,348 | B2 * | 8/2018 | Cavanagh | A43C 11/20 | |
| 10,327,513 | B2 * | 6/2019 | Soderberg | A43C 1/06 | |
| 10,342,294 | B2 * | 7/2019 | Lovett | A43C 15/00 | |
| 2002/0073487 | A1 * | 6/2002 | Phillips | A61G 1/04 | 5/628 |
| 2004/0016057 | A1 * | 1/2004 | Traut | A61F 5/055 | 5/628 |
| 2004/0049852 | A1 * | 3/2004 | Phillips | A61F 5/055 | 5/628 |
| 2011/0088148 | A1 * | 4/2011 | Chen | A42B 3/145 | 2/418 |
| 2011/0197362 | A1 * | 8/2011 | Chella | A61F 5/3761 | 5/650 |
| 2014/0123449 | A1 * | 5/2014 | Soderberg | A43C 1/003 | 24/712.1 |
| 2014/0290016 | A1 * | 10/2014 | Lovett | A43C 1/04 | 242/378.1 |
| 2015/0007422 | A1 * | 1/2015 | Cavanagh | A43C 11/165 | 29/434 |
| 2015/0107006 | A1 * | 4/2015 | Chen | A42B 3/324 | 2/418 |
| 2016/0058130 | A1 | 3/2016 | Boney et al. | | |
| 2017/0119104 | A1 * | 5/2017 | Soderberg | A43C 1/006 | |
| 2017/0202316 | A1 * | 7/2017 | Lovett | A43C 5/00 | |
| 2017/0303644 | A1 * | 10/2017 | Cavanagh | A61F 5/028 | |
| 2022/0000689 | A1 * | 1/2022 | Gordon | A61G 1/04 | |

FOREIGN PATENT DOCUMENTS

| | | | | |
|---|---|---|---|---|
| GB | 2578838 | A * | 5/2020 | A61F 5/05883 |
| WO | WO2006/130154 | | 12/2006 | |
| WO | WO-2020095045 | A1 * | 5/2020 | A61F 5/05883 |

* cited by examiner

MOTION RESTRICTION DEVICE

CROSS REFERENCE TO RELATED APPLICATIONS

This application claims priority as a National Stage of International Application No. PCT/GB2019/053142, filed Nov. 6, 2019, which claims the benefit of GB Patent Application No. 1818169.3, filed Nov. 7, 2018, the contents of which are herein incorporated by reference.

The present invention relates to a patient restraint, and a support table including the patient restraint. It is of particular use where a patient is admitted to hospital with a suspected back or neck injury, providing comfortable, effective immobilisation of the head, neck and upper back. A method of restraining the head, neck and upper back of an individual is also provided.

BACKGROUND TO THE INVENTION

Currently, in response to trauma where spinal injury is a possibility, paramedic teams use the 3 point immobilisation method when immobilising a patient. Subject to an evaluation procedure that assesses the patient based on factors such as the accident circumstances, age, pre-existing conditions, symptoms etc, the team will seek to secure the patients neck in an "in-line" neutral position, looking straight ahead (upwards).

Spine motion restriction consists of a neck brace/cervical collar, supports either side of the head (usually in the form of blocks) and a head strap, sometimes surgical tape is used.

This technique requires a significant amount of relatively cumbersome equipment, requiring considerable space, which is often at a premium in hospital emergency areas.

The immobilisation requires several steps. The supports either side of the head may provide different degrees of support which may result in the head of the patient being restrained in a twisted position.

Although this technique has been used for several years, it has several flaws. As more is understood about patient care, healthcare staff are slowly moving away from these methods, to the point whereby hospital procedures are being ignored in order to best serve the patient.

STATEMENT OF INVENTION

According to one aspect of the present invention there is provided a patient restraint assembly including:

- a head restraint configured to extend around the patient's head, said head restraint including a first end configured to be positioned towards one side of the patient's head and a second end configured to be positioned towards the other side of the patient's head,
- at least one securement member extending from the first end of the head restraint, and at least one securement member extending from the second end of the head restraint, said securement members being configured to releasably secure said head restraint to a support table,
- an adjustment unit to adjust the tension in the securement members,
- wherein adjustment of the adjustment unit applies the same force simultaneously to the securement member(s) at the first end and the securement member(s) at the second end of the head restraint.

Generally, each of the securement members is attached to the adjustment unit at an affixment, wherein the or each affixment is movable relative to the central lateral axis of the head restraint between a tensioned and an untensioned position and movement from the untensioned position towards the tensioned position increases the tension in the securement members. Typically movement from the untensioned position towards the tensioned position results in the affixment(s) moving towards the central lateral axis of the head restraint.

According to an aspect of the present invention, there is provided a patient restraint including:

- a support table,
- a head restraint configured to extend around the patient's head, said head restraint including a first end configured to be positioned towards one side of the patient's head and a second end configured to be positioned towards the other side of the patient's head,
- at least one securement member extending from the first end of the head restraint, and at least one securement member extending from the second end of the head restraint, said securement members releasably securing said head restraint to said support table,
- an adjustment unit to adjust the tension in the securement member(s),
- wherein adjustment of the adjustment unit applies the same force simultaneously to the securement member(s) at the first end and the second end of the head restraint.

Generally the tension in the securement member(s) at the first end of the head restraint is the same as the tension in the securement member(s) at the second end of the head restraint, resulting in the same force being applied to both sides of the patient's head and avoiding the patient's head being twisted during restraint.

Preferably the securement member(s) extend from the first end of the head restraint in a first direction and in a second direction separated by 20 to 120 degrees and the securement member(s) extend from the second end of the head restraint in a third and fourth direction separated by 20 to 120 degrees.

According to a further aspect of the present invention, there is provided a method of restraining a patient using the patient restraint described herein comprising:

- placing the patient on the support table;
- extending the head restraint around the patient's head;
- securing the head restraint to the support table using the securement members, said securement members extending from the first end and the second end of the head restraint, generally in the first, second, third and fourth directions;
- adjusting the tension in the securement member(s) through adjustment of the adjustment unit.

According to a further embodiment there is provided a kit of parts comprising the patient restraint, or the patient restraint assembly as described herein and instructions for use. The kit may include the patient restraint assembly described herein (that is without the support table), as the head restraint may be secured to the support table using the securement members immediately prior to use. The support table may suitably be a spine board, stretcher or bed already present in the medical setting where restraint takes place and may be sold separately to the patient restraint assembly described herein. According to one embodiment, the patient restraint assembly described herein may be used to restrain or immobilise a user's head to a head rest of a seat, for example an aeroplane or ambulance seat. In such embodiments, the support table may be in the form of the head rest of a seat.

Where appropriate, teaching relating to any aspect or embodiment may relate to any other embodiment.

Throughout the Application, where a device is described as having, including, or comprising specific components, or where methods are described as having, including, or comprising specific method steps, it is contemplated that device of the present teachings also consist essentially of, or consist of, the recited components, and that the methods of the present teachings also consist essentially of, or consist of, the recited method steps.

In the Application, where an element or component is said to be included in and/or selected from a list of recited elements or components, it should be understood that the element or component can be any one of the recited elements or components, or the element or component can be selected from a group consisting of two or more of the recited elements or components. Further, it should be understood that elements and/or features of a device, or a method described herein can be combined in a variety of ways without departing from the spirit and scope of the present teachings, whether explicit or implicit herein.

The use of the terms "include," "includes", "including,", "comprise", "comprises" "comprising", "have," "has," or "having" should be generally understood as open-ended and non-limiting unless specifically stated otherwise.

The use of the singular herein includes the plural (and vice versa) unless specifically stated otherwise. All numerical values provided incorporate 10% less than and 10% more than the numerical value provided.

In addition, where the use of the term "about" is before a quantitative value, the present teachings also include the specific quantitative value itself, unless specifically stated otherwise. As used herein, the term "about" refers to a ±10% variation from the nominal value unless otherwise indicated or inferred.

It should be understood that the order of steps or order for performing certain actions is immaterial so long as the present teachings remain operable. Moreover, two or more steps or actions may be conducted simultaneously.

Features, integers, characteristics, or groups described in conjunction with a particular aspect, embodiment or example of the invention are to be understood to be applicable to any other aspect, embodiment or example described herein unless incompatible therewith.

DETAILED DESCRIPTION

According to one aspect of the present invention there is provided a patient restraint assembly including:

- a head restraint configured to extend around the patient's head, said head restraint including a first end configured to be positioned towards one side of the patient's head and a second end configured to be positioned towards the other side of the patient's head,
- at least one securement member extending from the first end of the head restraint, and at least one securement member extending from the second end of the head restraint, said securement members being configured to releasably secure said head restraint to a support table,
- an adjustment unit to adjust the tension in the securement members,
- wherein adjustment of the adjustment unit applies the same force simultaneously to the securement member(s) at the first end and the securement member(s) at the second end of the head restraint.

Adjustment of the adjustment unit from an untensioned position towards a tensioned position may increase the tension in the securement member(s) at the first end and the second end of the head restraint by the same amount. Generally, the tension in the securement member(s) at the first end of the head restraint is the same as the tension in the securement member(s) at the second end of the head restraint.

Typically, the length of the securement member(s) at the first end of the head restraint is the same as the length of the securement members at the second end of the head restraint.

Suitably, the securement member(s) at the first end of the head restraint and the securement member(s) at the second end of the head restraint are provided at the same angle(s) from the central lateral axis of the head restraint.

According to an aspect of the present invention, there is provided a patient restraint including:

- a support table,
- a head restraint configured to extend around the patient's head, said head restraint including a first end configured to be positioned towards one side of the patient's head and a second end configured to be positioned towards the other side of the patient's head,
- at least one securement member releasably securing said head restraint to said support table, said securement member(s) extending from the first end and the second end of the head restraint,
- an adjustment unit to adjust the tension in the securement member(s),
- wherein adjustment of the adjustment unit applies the same force simultaneously to the securement member(s) at the first end and the second end of the head restraint.

The patient restraint and patient restraint assembly of the present invention allows restraint prior to or during assessment of potential neck or back injury. The patient restraint of the present invention is less bulky than commonly used restraints and allows more controlled adjustment thereof.

Adjustment of the adjustment unit results in the same force being applied to the securement means exerting a force at the first side and the second side of the head restraint simultaneously. As the same three is applied to both sides simultaneously, the risk of the patient's head twisting during the tightening procedure is reduced or such twisting is prevented. Any head or neck injury may be exacerbated if the head twists during restraint. Generally, adjustment of the adjustment unit is through a single mechanism (for instance a twisting, sliding mechanism). This is highly beneficial in a busy hospital admissions department. The adjustment of the adjustment unit is generally incremental, reducing the risk of the securement members being over-tightened which may lead to patient injury.

Generally, the adjustment unit applies the same force simultaneously to all of the securement member(s).

Preferably the securement member(s) extend from the first end of the head restraint in a first direction and in a second direction separated by from 5 to 120 degrees, generally from 10 to 120 degrees, or more preferably from 20 to 120 degrees and the securement member(s) extend from the second end of the head restraint in a third and fourth direction separated by from 5 to 120 degrees, generally from 10 to 120 degrees, or more preferably 20 to 120 degrees.

The device of the present invention thus generally exerts two forces in different directions at each side of the head restraint, and thus on each side of the patient's head. This triangulation of forces reduces the risk of flexion of the patient's head up and down through restraint in four different directions.

Generally the patient restraint includes two securement members, the first extending from the first end of the head restraint in two directions, and the second extending from the second end of the head restraint in two directions. The use of a single securement member at the first end, results in the equilibration of tension in the securement member extending in the first direction and in the second direction. Likewise, the use of a single securement member at the second end, results in the equilibration of tension in the securement member extending in the third direction and in the fourth direction. This equilibration of tension at each of the first end and the second end reduces the risk of the head being twisted up or down during tightening of the head restraint.

According to one embodiment, the securement members are secured to the support table. The head restraint may be provided at a longitudinal position on the support table between the positions at which the securement member(s) at each end of the head restraint are secured to the support table.

Typically, in use, the securement member(s) at each of the first and second ends of the head restraint is secured to the support table at a longitudinal position greater than and less that the position of the patient's head. In such embodiments, the securement member at each of the first and second ends of the head restraint may be secured to the support table at a longitudinal position above the patient's head, and at a longitudinal position below the patient's head, or at the same level as the patient's head, typically at the level of the patient's shoulders.

The support table comprises a head end towards which the patient's head is provided during use, and a foot end, towards which the patient's feet are provided during use. According to one embodiment, the head restraint is at a longitudinal position closer to the head end of the support table than the positions at which the securement members at each end of the head restraint are secured to the support table.

Typically, in use, the securement member(s) at each of the first and second ends of the head restraint is secured to the support table at two longitudinal positions, and generally both of the longitudinal positions are further from the head end of the support table than the patient's head. In such embodiments, the securement member at each of the first and second ends of the head restraint may be secured to the support table at a longitudinal position below the patient's head. Typically, the securement member at each of the first and second ends of the head restraint is secured to the support table at a longitudinal position approximately equivalent to the longitudinal position of the patient's ears, and at a longitudinal position approximately equivalent to the longitudinal position of the patient's shoulders.

According to one embodiment, the support table includes handles and the securement member(s) are secured around the handles. The securement member(s) may be secured using any suitable fastening means. Mention may be made of a clip, button, zip and hook and loop fastening such as that sold under the trade name Velcro®. According to another embodiment the securement member(s) are secured to any part of the support table, and the member(s) are preferably secured by tying around part of the support table or any other suitable object. The member(s) may be secured by additional means (such as any mentioned above) in addition to being tied to the support table or other object.

The securement member(s) may include at least one of a cord, rope, flat or rounded strap, and tape (such as medical tape, for example stretchy medical tape). The tape may particularly be used in conjunction with the tying feature mentioned above. The cord may particularly be used in conjunction with the clip and/or hook features mentioned above. The securement member(s) may thus be made of fabric, metal or plastic, and so on. The securement member(s) may be substantially rigid or may be substantially compliant, for example in the case of stretchy medical tape. If the securement member(s) are non-rigid, this can aid in distributing the force evenly on both ends of the head restraint.

The first and second directions are generally separated by 40 to 100 degrees, suitably 60 to 90 degrees. The third and fourth directions are generally separated by 40 to 100 degrees, suitably 60 to 90 degrees.

In one embodiment the first and second directions and third and fourth directions are generally separated by 5 to 40 degrees, 10 to 30 degrees and more preferably 15 to 25 degrees.

Typically, all of the securement members extend downwardly in use, away from the top of the user's head, and approximately towards the user's shoulders. This reduces the risk of extension of the user's neck. Such an embodiment reduces the risk of the user's head being tilted backwards whilst restrained. The head restraint may be positioned to maintain the user's head in a non-extended position. Extension of the neck of the user is resisted through the angling of the securement members and the tension in the securement members, fixed by the affixment (suitably by pegs).

The head restraint includes a first side, disposed between the first and second ends and configured to face towards the top of the patient's head in use. According to one embodiment, the securement member(s) at the first end of the head restraint extend from the first end at an angle of more than 90 degrees from the plane intersecting the mid-point of the head restraint (generally provided at or close to the patient's forehead in use) and the first side of the head restraint. According to one embodiment, the securement member(s) at the first end of the head restraint extend from the first end at an angle of less than 170 degrees from the plane intersecting the mid-point of the head restraint (generally provided at or close to the patient's forehead in use) and the first side of the head restraint.

Generally the securement member(s) at the second end of the head restraint extend from the second end at an angle of more than 90 degrees from the plane intersecting the mid-point of the head restraint (generally provided at or close to the patient's forehead in use) and the first side of the head restraint. According to one embodiment, the securement member(s) at the second end of the head restraint extend from the second end at an angle of less than 170 degrees from the plane intersecting the mid-point of the head restraint (generally provided at or close to the patient's forehead in use) and the first side of the head restraint.

According to one embodiment, all of the first, second, third and fourth directions are provided at an angle of more than 90 degrees, and less than 170 degrees from the plane intersecting the mid-point of the head restraint and the first side of the head restraint. Typically the first and second directions are between 95 to 135 degrees from the plane intersecting the mid-point of the head restraint and the first side of the head restraint (moving anti-clockwise). Typically the third and fourth directions are between 230 and 265 degrees from the plane intersecting the mid-point of the head restraint and the first side of the head restraint (moving clockwise).

The head restraint may be in the form of an elongate member configured to extend around at least 50% of the patient's head in use. Preferably the head restraint extends across the patient's forehead in use, or otherwise extends across the front of the patient's head in use. Preferably the head restraint does not extend across at least part of the side of the patient's head in use, and more preferably the head restraint does not extend around the back of the patient's head. Preferably the head restraint does not contact the board, and preferably the head restraint is not connected to the board except via the securement member(s). Preferably only a single head restraint is provided, thus providing greater simplicity and economy.

As noted above, the securement member(s) may extend from the first end of the head restraint in a first and second direction and the securement member(s) may extend from the second end of the head restraint in a third and fourth direction. The first direction may be 10 to 60 degrees (generally 20 to 50 degrees) from the longitudinal axis of the elongate member. The second direction may be 300 to 350 degrees (generally 310 to 340 degrees) from the longitudinal axis of the elongate member. The third direction may be 120 to 170 degrees (generally 130 to 160 degrees) from the longitudinal axis of the elongate member. The fourth direction may be 190 to 240 degrees (generally 200 to 230 degrees) from the longitudinal axis of the elongate member.

According to a further embodiment, there is provided a restraint assembly wherein the head restraint is in the form of an elongate member configured to extend around at least 50% of the patient's head in use,

- the first direction is 95 to 120 degrees from the plane intersecting the mid-point of the head restraint and the first side of the head restraint,
- the second direction is 110 to 135 degrees from the plane intersecting the mid-point of the head restraint and the first side of the head restraint,
- the third direction is 230 to 250 degrees from the plane intersecting the mid-point of the head restraint and the first side of the head restraint, and
- the fourth direction, 240 to 265 degrees from the plane intersecting the mid-point of the head restraint and the first side of the head restraint.

The patient restraint is suitably symmetrical along the central lateral axis of the head restraint, disposed between the first end and the second end thereof. The patient restraint is thus suitably symmetrical along the central longitudinal axis of the patient's head/face.

According to one embodiment, each of the securement members may be attached to the adjustment unit at an affixment, wherein the, or each affixment is movable between a tensioned and an untensioned position. Movement from the untensioned position towards the tensioned position increases the tension in the securement members. Movement of the affixment(s) between the tensioned and untensioned position may be in a straight line or may be rotational. Typically the affixment(s) are slid in a straight line between the tensioned and untensioned position.

Generally movement of the affixment(s) between the tensioned and untensioned positions is relative to the central lateral axis of the head restraint. In use, movement between the tensioned and untensioned positions is relative to the central longitudinal axis of the patient's head/face.

Generally, all of the affixments are movable between a tensioned and an untensioned position through adjustment of one mechanism.

Each securement member may be attached to the same affixment. Alternatively, each securement member may be attached to a different affixment. Generally, all or the securement member(s) at the first end of the head restraint are attached to a first affixment, and all of the securement member(s) at the second end of the head restraint are attached to a second affixment. According to one embodiment, the head restraint includes two securement members, and two affixments.

Typically, movement of the affixments from the untensioned position towards the tensioned position is effected by movement of the affixments towards each other.

Generally all affixments are movable between the tensioned and untensioned positions through movement or activation of one mechanism. The mechanism may involve rotational or straight line movement, typically rotational movement of the mechanism results in a straight line movement of the affixment(s) between the tensioned and untensioned positions.

The adjustment unit generally includes one or more bodies comprising the affixment(s). The bodies may suitably elongate, with the affixment provided towards one end thereof. According to one embodiment, the affixment(s) may be movable between a tensioned and untensioned position through adjustment of an adjustment mechanism which cooperates with the body or bodies which include the affixment(s) causing movement thereof. Typically, the adjustment mechanism may comprise teeth which interlock with teeth provided on the body or bodies which include the affixment(s). Typically the body comprising the affixment includes teeth at the side thereof facing the adjustment mechanism (typically a wheel). Generally the adjustment mechanism includes an adjustment mechanism and two bodies, each comprising an affixment, one of the bodies provided at one side of the adjustment mechanism and the other of the bodies provided at another side of the adjustment mechanism. Suitably, the adjustment mechanism may be in the form of a wheel which cooperates with one or more bodies comprising the affixment(s). The wheel and the bodies comprising the affixments may include interlocking teeth. Accordingly, rotation of the wheel causes movement of the bodies, and movement of the affixments between the tensioned and untensioned positions. Preferably the wheel is substantially flush with the adjustment unit, for example extending no further than the pegs mentioned below. This can avoid interfering with movements around the patient and can avoid accidental re-adjustment of the tension.

The affixment may suitably be in the form of a peg, pin or hook to which the securement member is affixed. The affixment may have a squared cross section, or be formed from a high friction, rough or gnarled surface to reduce the risk of the securement means slipping. The affixment may alternatively have a substantially smooth surface or otherwise be configured to allow the securement means to slip around the affixment, for example to allow tension in the securement member(s) to redistribute if unbalanced. At the same time (or otherwise) the affixment may have a flared or otherwise enlarged top to prevent the securement means slipping off the affixment in an axial direction.

Preferably the securement member(s) and affixment(s) are configured such that the securement member(s) can be attached to the affixment(s) after the patient is placed on the board, for example by hooking the securement member(s) on the affixment(s) when the patient is in place. Thus the affixment(s) are preferably temporary, and preferably the securement member(s) can be released by pulling them off the affixment(s) in a particular direction. Preferably the securement member(s) and affixment(s) are configured such that when the patient is restrained, the securement mean(s) do not contact the patient. Preferably they are further configured such that the securement mean(s) are free to be moved away from the patient (that is, there are no other constraints on the securement mean(s) except at the ends) as soon as the securement mean(s) is released from the affixment(s), which is especially advantageous when the affixment(s) may be temporary and/or easy to undo, as mentioned above. This can make it quick and easy to remove the securement member(s) when it is necessary to remove the patient. Preferably the securement member(s) do not, in use, contact anything except the adjustment means and the supporting board or bed. This can also improve the sterility of the device.

Preferably the affixment(s) must be placed in the untensioned position before the securement member(s) can be removed. In this case, the securement member(s) can be removed from a fully restrained patient in two steps (release tension, pull off securement members) and from an unrestrained patient in one step. Preferably the affixment extends in a direction away from where the distal ends of the securement member(s) are attached in use, so as to create a relatively efficient attachment.

Preferably the restraint assembly is configured such that a patient's head can be restrained using a minimum of two attachment points between the assembly and a supporting board or bed (with two securement members, one on each end), and more typically using a minimum of four attachment points (with four securement members, two on each end). Preferably the restraint assembly is configured such that no other attachment points are provided (or required). This can facilitate balancing the tension on both ends, and minimise interference from additional reaction forces.

According to one embodiment, the adjustment unit may be releasably attached to the head restraint, typically provided in use at the front of the patient's head for ease of adjustment.

Alternatively, the adjustment unit may be provided towards the first or the second end of the head restraint, or in some embodiments, elsewhere for instance proximate to the support table.

The head restraint unit may include a head pad to support the back of the patient's head in use. The head pad is suitably for placement on the support table and may be secured to the support table by any suitable means. Mention may be made of high friction materials and hook and loop fastening such as that sold under the trade mark Velcro®.

The head pad may include a depression for accommodating the head of a patient. Suitably the head pad has an associated thickness of at least 2 cm ensuring the head of the patient is elevated by 2 to 4 cm during use. This is desirable for spinal alignment.

The head pad is generally concave, providing a large surface contact area for the patient's head. This reduces spine flexion and/or extension during use.

According to one embodiment, the head restraint includes one or more straps extending around the patient's head. The head restraint is generally secured to the head pad. The head restraint is generally offset from the centre of the head pad, such that, in use, the head restraint extends around the lower part patient's head towards the patient's neck. The head restraint may be offset from the centre by at least 30% of the diameter of the head pad. Generally the head restraint is provided towards the outer third of the head pad. This offsetting reduces the risk of the head restraint becoming dislodged, for instance by slipping off the patient's forehead, following tightening.

Typically, the head restraint includes two straps, secured to the head pad and secured to the adjustment unit. The head restraint is generally non-removably attached to the head pad, for instance through stitching. Any suitable means may be used to secure the head restraint to the adjustment unit. Mention may be made of hook and loop fastening such as that sold under the trade mark Velcro®, clip or zip.

The head restraint is generally adjustable to accommodate differences in patients' head size. This may be achieved by folding the straps of the head restraint back on themselves following insertion through one or more openings in the adjustment unit.

The head restraint generally takes the shape of the patient's head when tightened. Alternatively or additionally, the head restrain may be curved to comfortably accommodate the patient's head. This allows the tension in the head restraint to be spread evenly, and increases the contact area between the head restraint and the patient's head. The patient's comfort is increased accordingly.

The support table may be a spine board, stretcher, bed, trolley or surgical support table. Generally the support table is in a hospital, care home or ambulance. Alternatively the support table may be head rest of a seat, in particular an aeroplane or ambulance seat.

According to one aspect of the present invention there is provided a patient restraint assembly including:

a head restraint configured to extend around the patient's head, said head restraint including a first end configured to be positioned towards one side of the patient's head and a second end configured to be positioned towards the other side of the patient's head, two securement members configured to releasably secure said head restraint to a support table, an adjustment unit to adjust the tension in the securement members, wherein one of the securement members extends from the first end of the head restraint in a first direction and in a second direction separated by 20 to 120 degrees and the other of the securement members extends from the second end of the head restraint in a third and fourth direction separated by 20 to 120 degrees, an adjustment unit to adjust the tension in the securement member(s), wherein adjustment of the adjustment unit applies the same force simultaneously to the securement member(s) at the first end and the second end of the head restraint.

Generally each of the securement members is attached to the adjustment unit through an affixment movable between a tensioned and an untensioned position.

Typically, the first, second, third and fourth directions are at an angle of more than 90 degrees from the plane intersecting the mid-point of the head restraint and the first side of the head restraint, configured to face towards the top of the patient's head in use.

The patient restraint assembly may be provided with a support table, and/or may be suitable for use on any support table (for instance spine board, bed, stretcher trolley, seat head rest etc.). Where the patient restraint assembly is for use with standard support tables (spine boards, beds, trolleys, stretchers etc.), additional means to secure the securement members to the support table may be included. Mention may be made of clamps, clips, and hook and loop fastenings in this regard. Alternatively, the securement member(s) may be configured to extend around or under the support table. According to one embodiment, the patient restraint/patient restraint assembly may include a single securement means, connected to two affixments and extending under the support table.

According to a further aspect of the present invention, there is provided a method of restraining a patient using the patient restraint assembly described herein comprising:

placing the patient on the support table;

extending the head restraint around the patient's head;

securing the head restraint to a support table using the securement member(s), said securement member(s) extending from the first end and the second end of the head, generally in the first, second, third and fourth directions;

adjusting the tension in the securement member(s) through adjustment of the adjustment unit.

The head restraint is generally extended around the patient's head prior to tightening of the head restraint. The tightening may deform the head restraint to the patient's head curvature or the head restraint may have a curved profile prior to tightening.

The securement member(s) are used to secure the head restraint to the support table, generally at four positions. Typically, the securement member(s) are secured at each of the first and second ends of the head restraint to the support table at a longitudinal position above the position of the patient's head, and at the level of the patient's head, or below the level of the patient's head.

According to one embodiment, the securement member(s) are secured to the support table at a longitudinal position at, or below the position of the patient's head, typically all of the securement members are secured to the support table at a longitudinal position below the position of the patient's forehead, that is at a longitudinal distance greater than the longitudinal distance between the patient's forehead and the head end of the support table.

Generally a securement member at the first side and at the second side is secured to the support table at approximately the longitudinal position of the patient's ear, and a securement member at the first side and at the second side is secured to the support table at a longitudinal position between the bottom of the patient's ear and the patient's shoulder.

Generally all of the securement members extend downwardly from the patient's forehead and this reduces the risk of the patient's neck extending during restraint which can be associated with an increased risk of damage or injury.

The tension in the securement member(s) may be adjusted using the adjustment unit after being secured to the support table, generally to pull the head restraint in at least four directions. Adjustment of the adjustment unit applies the same force simultaneously to the securement member(s) at the first end and the second ends of the head restraint. Typically adjustment of the adjustment unit applies the same force simultaneously to all of the securement members simultaneously.

Kit

According to a further aspect of the present invention there is provided a kit of parts comprising the patient restraint as described herein or the patient restraint assembly as described herein and instructions for use. The patient restraint may be provided in more than one part, for assembly immediately prior to use. For instance, the adjustment unit may be provided separately to the head restraint, and the securement means may be provided unattached to the head restraint or the adjustment unit.

The present invention will now be described by way of example only with reference to the accompanying figures in which.

Figure 1:
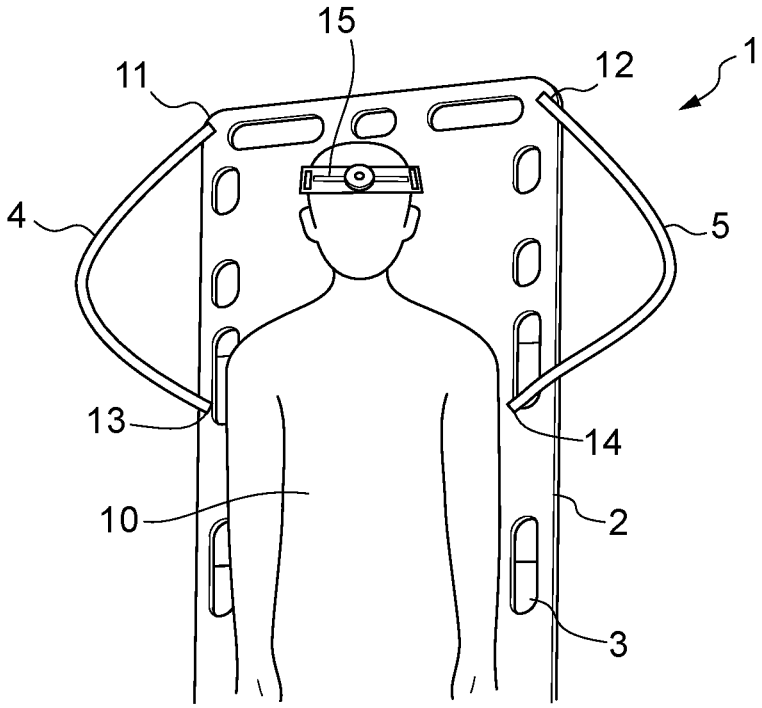
FIG. 1 shows a schematic representation shown from above of the patient restraint of the present invention prior to attachment of the securement members to the head restraint.
Figure 2:
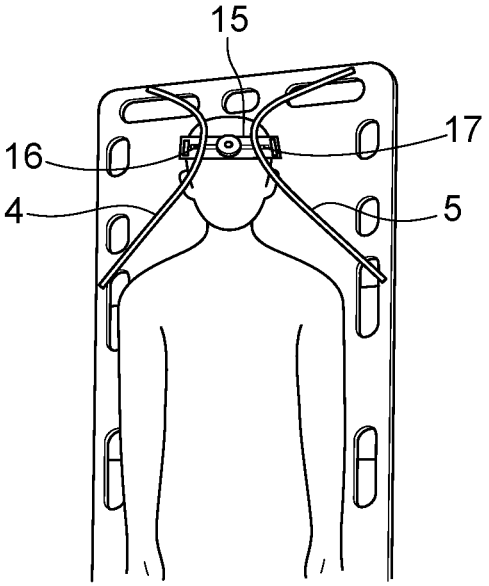
FIG. 2 shows a schematic representation shown from above of the patient restraint of FIG. 1 following attachment of the securement members to the head restraint.
Figure 3:
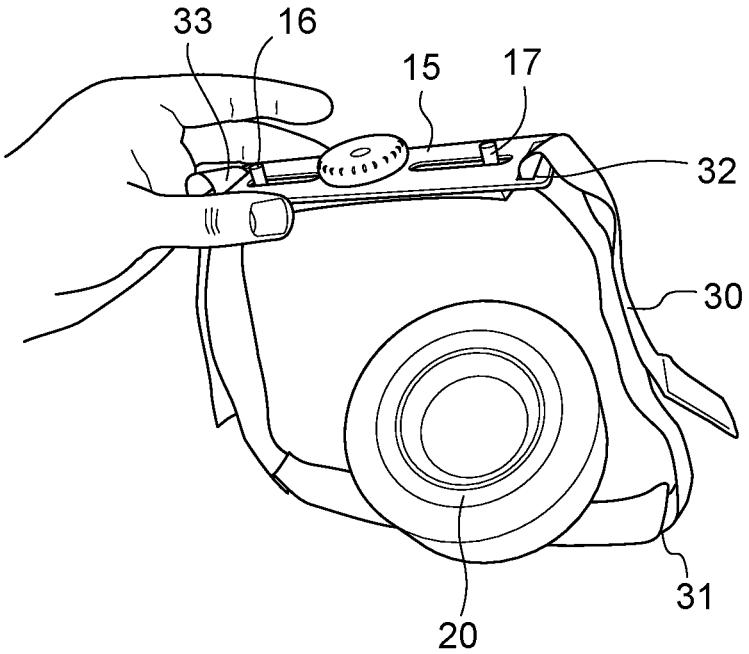
FIG. 3 shows a schematic representation of the head restraint of the present invention without the securement members.
Figure 4:
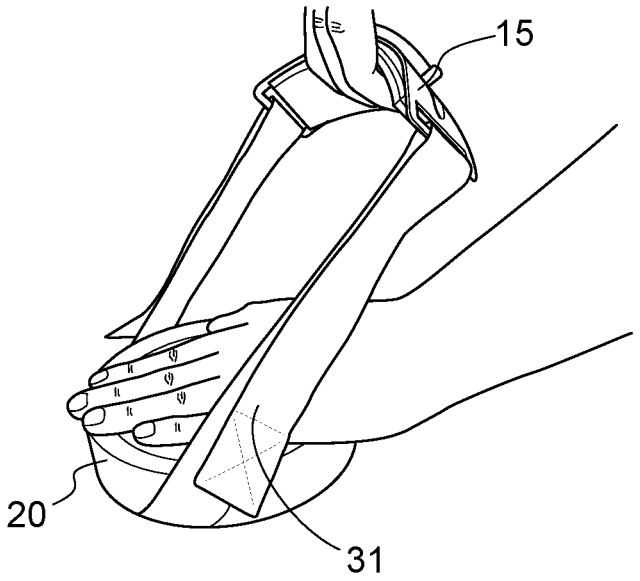
Figure 5:
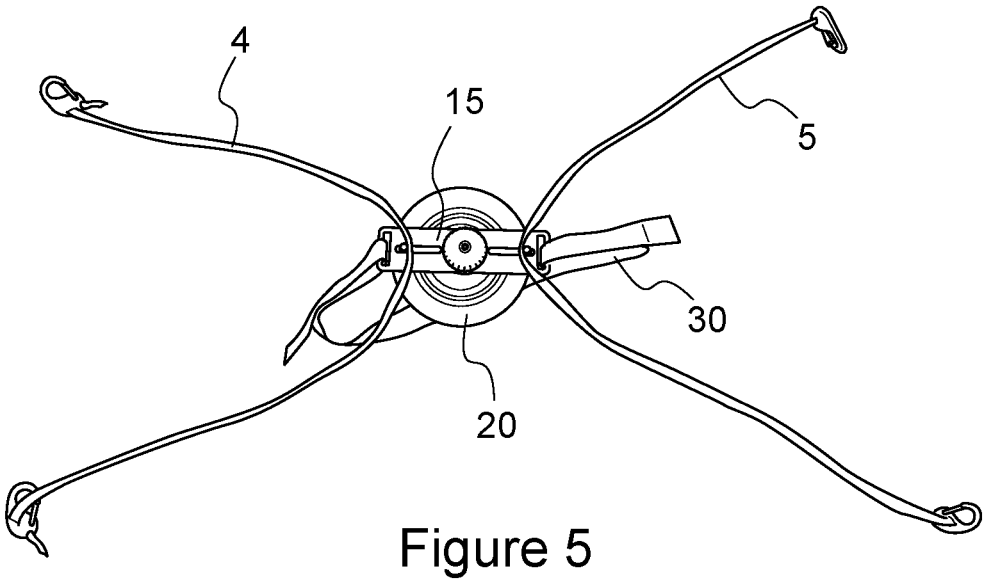
Figure 6:
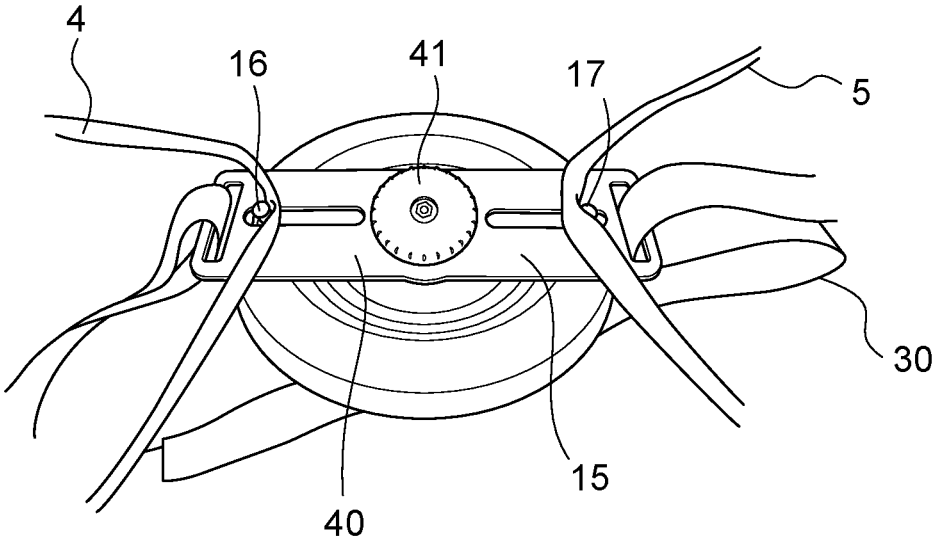
Figure 7:
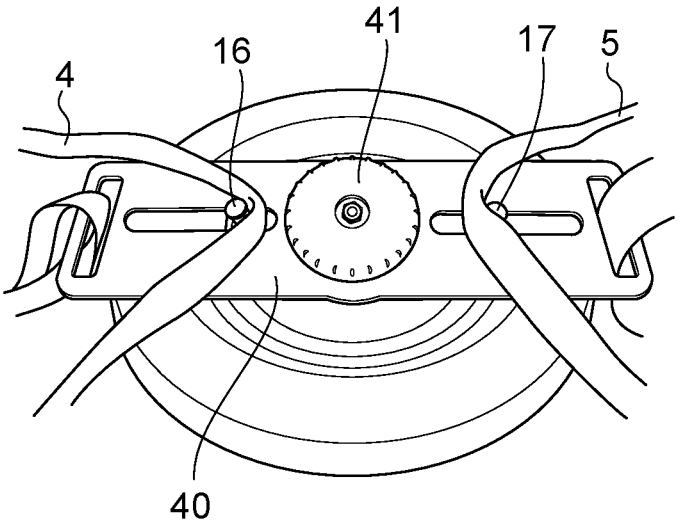
Figure 8:
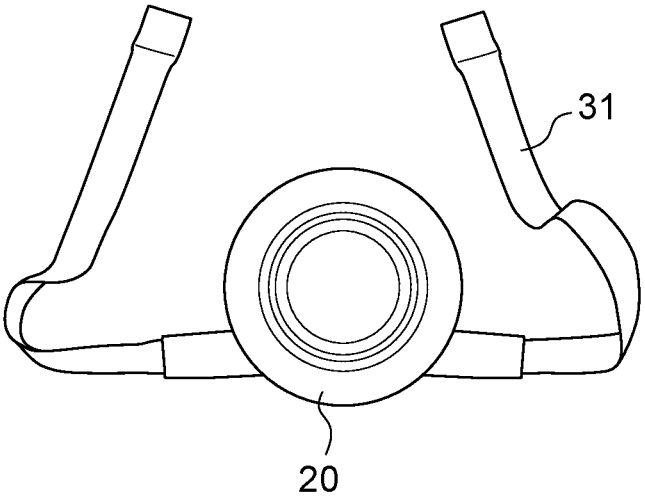
Figure 9:
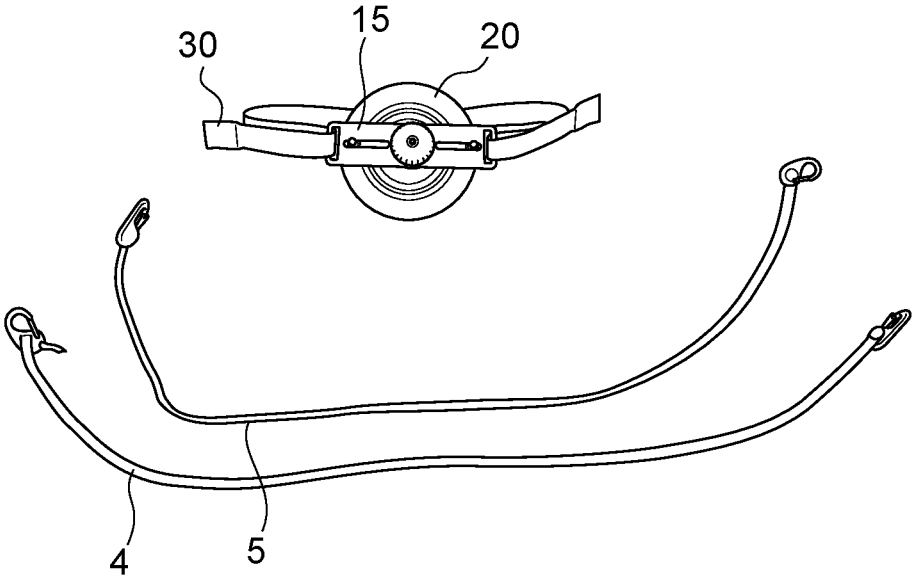
Figure 10A:
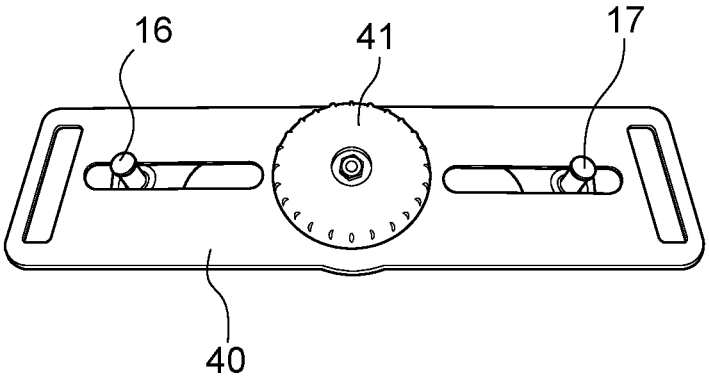
Figure 10B:
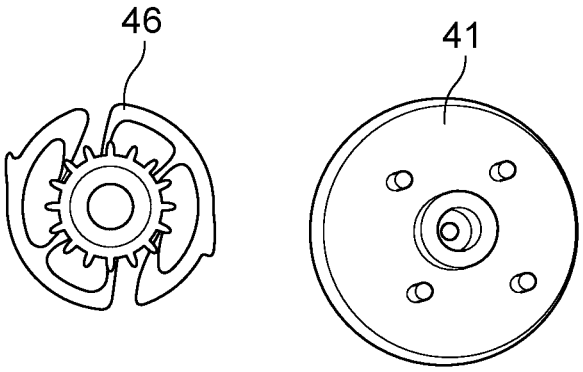
Figure 10C:
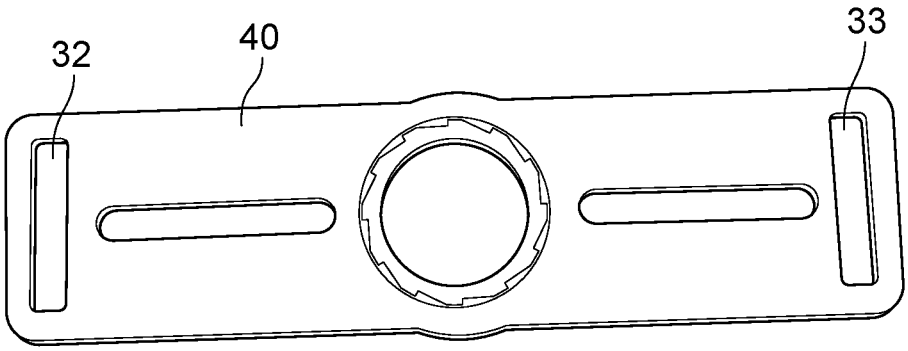
Figure 10D:
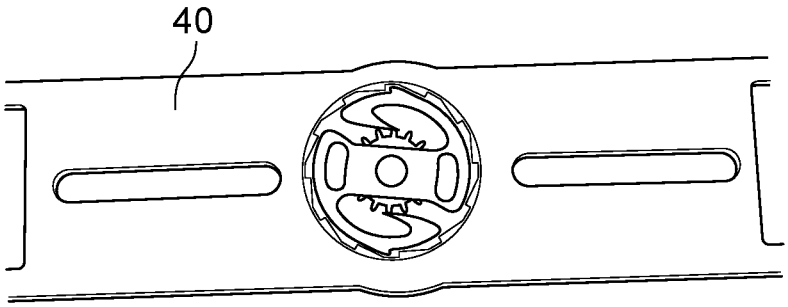
Figure 10E:
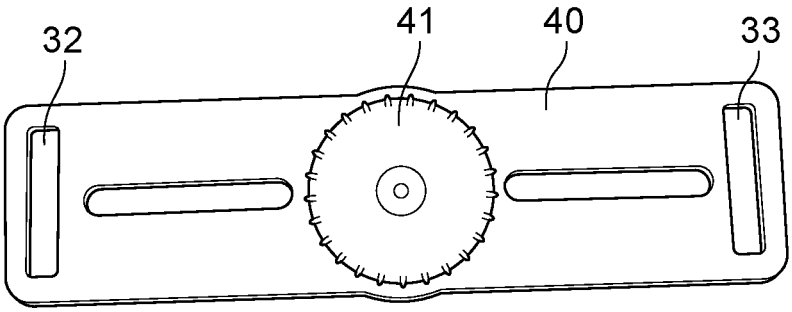
Figure 10F:
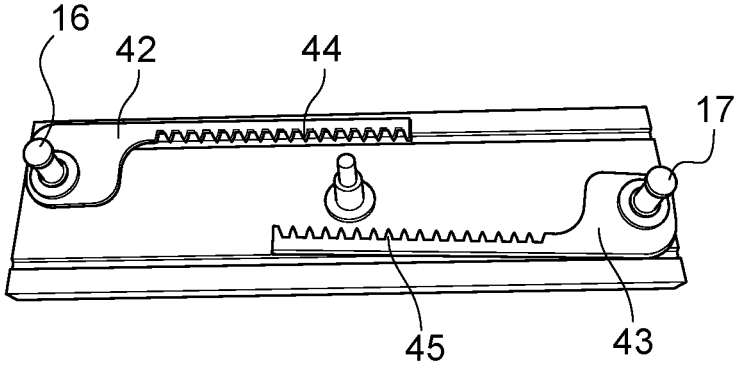
Figure 10G:
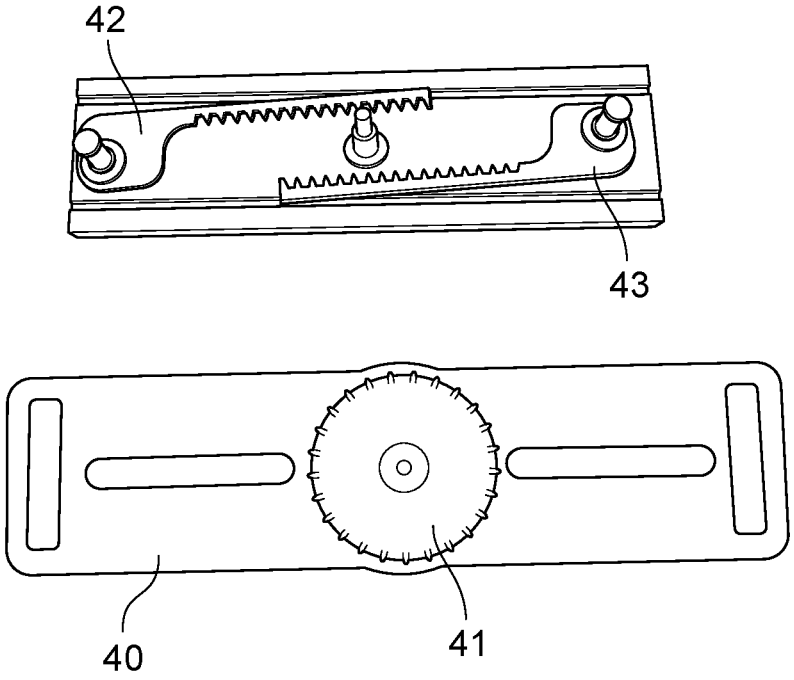
Figure 10H:
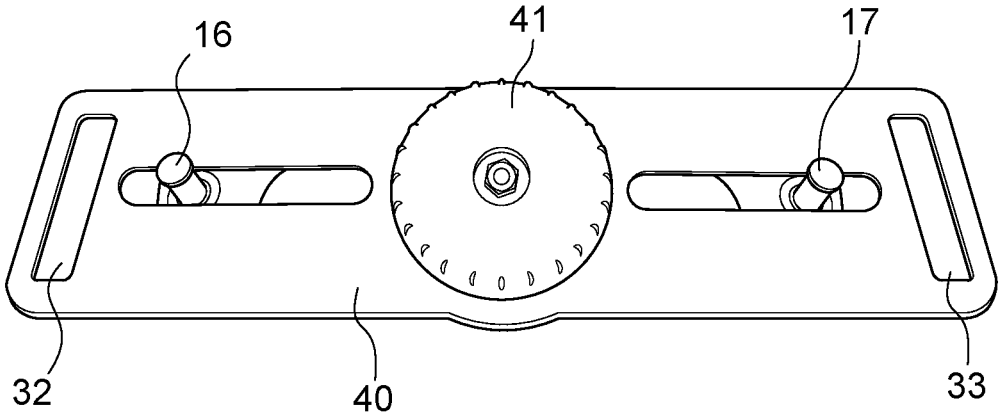
Figure 10I:
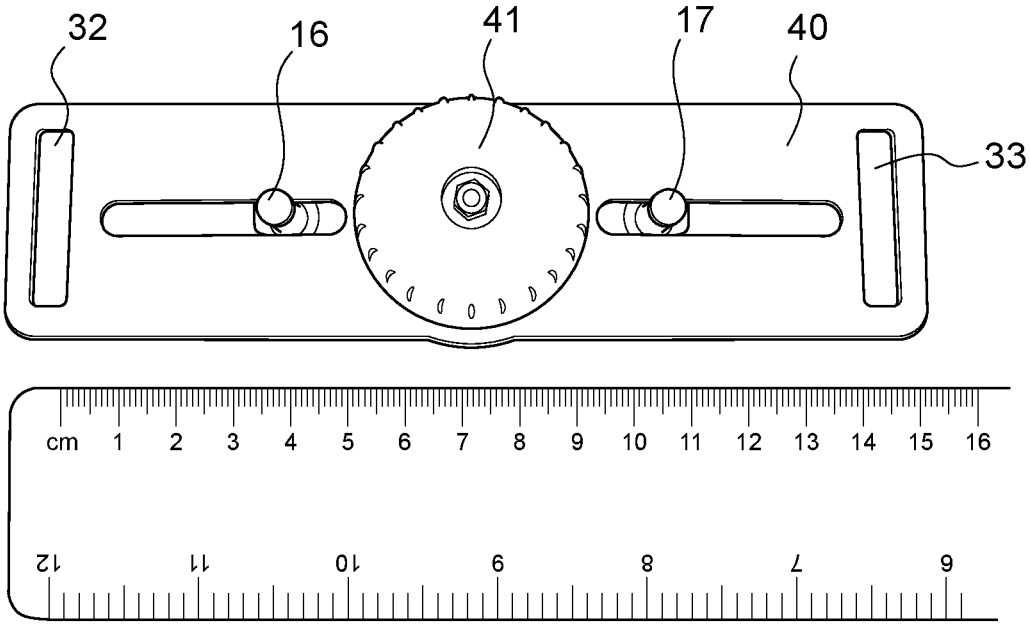
Figure 11A:
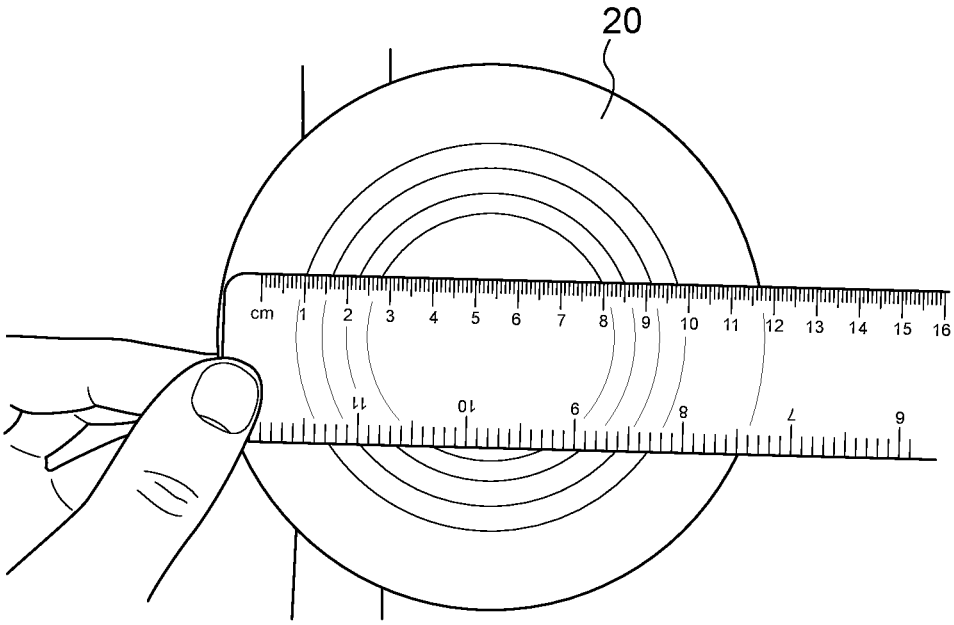
Figure 11B:
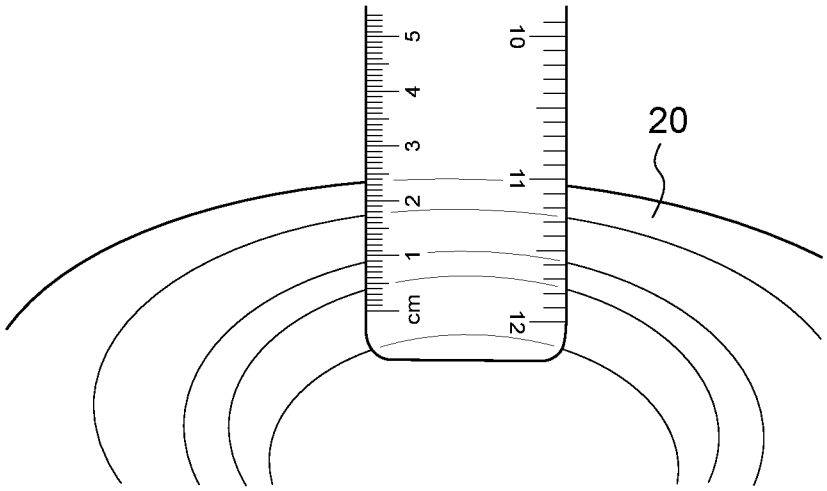
Figure 11C:
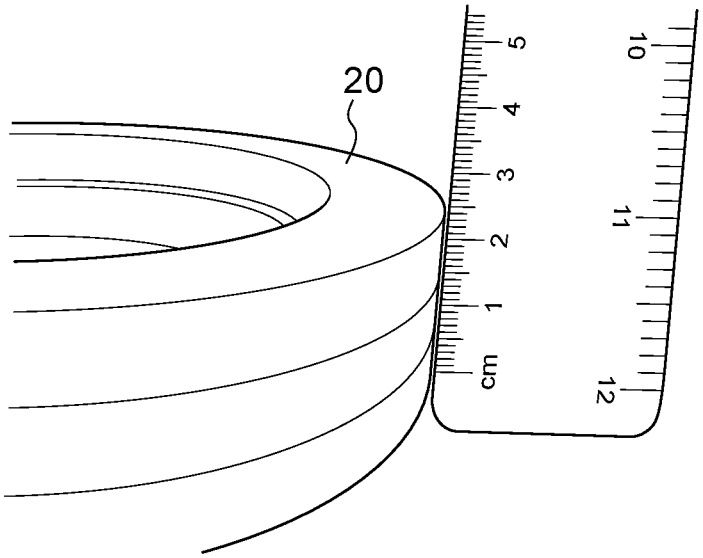
Figure 11D:
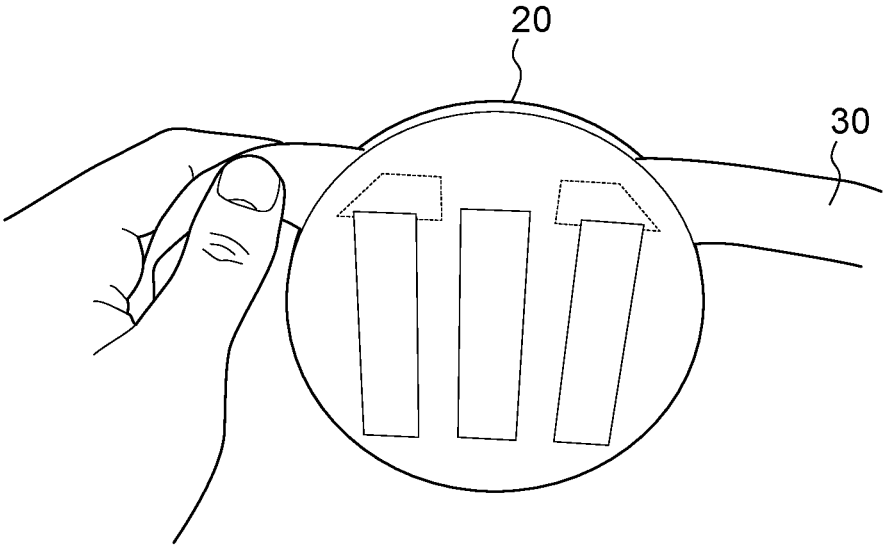
Figure 12:
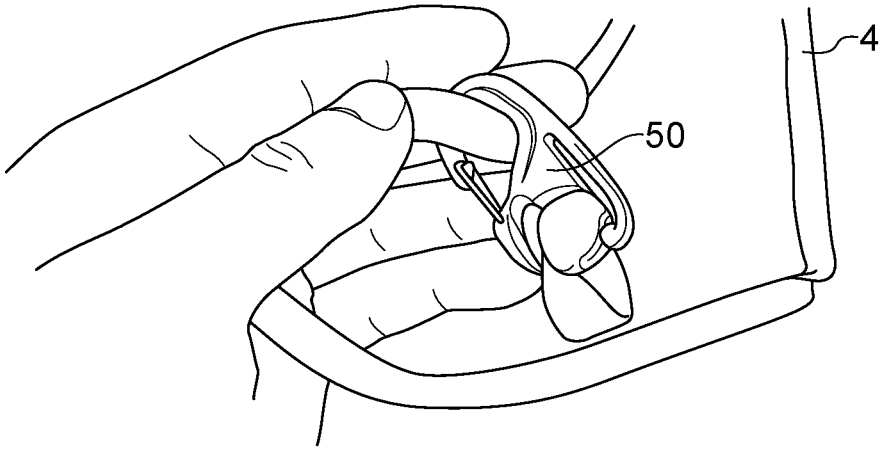
Figure 13:
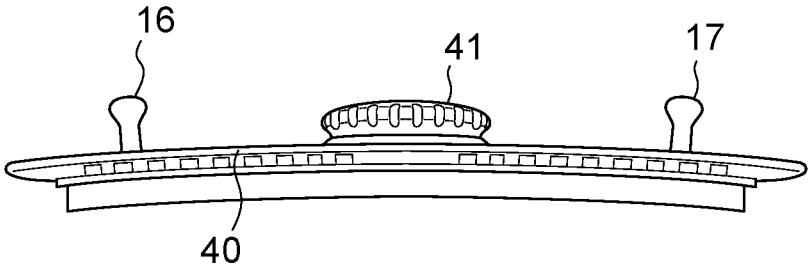
Figure 14A:
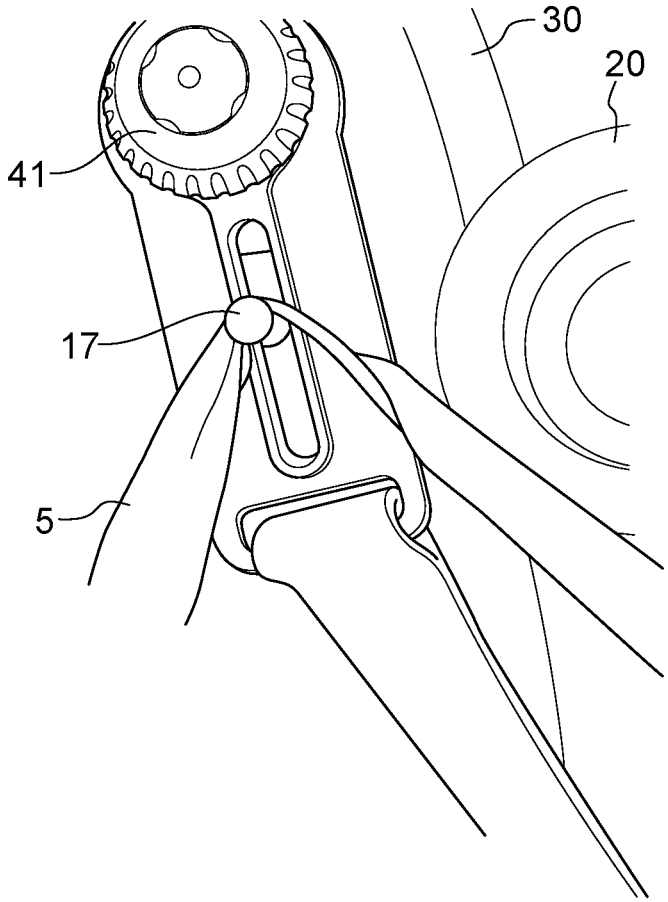
Figure 14B:
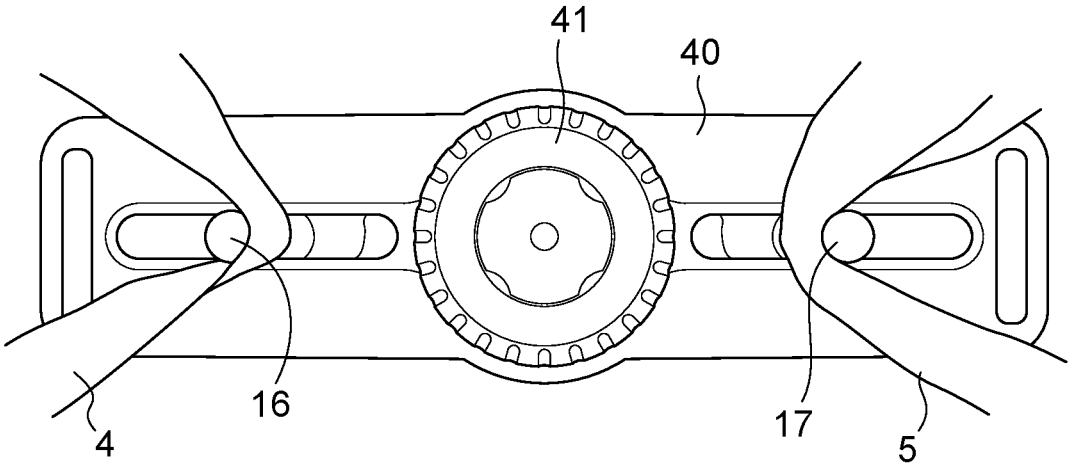
Figure 15A:
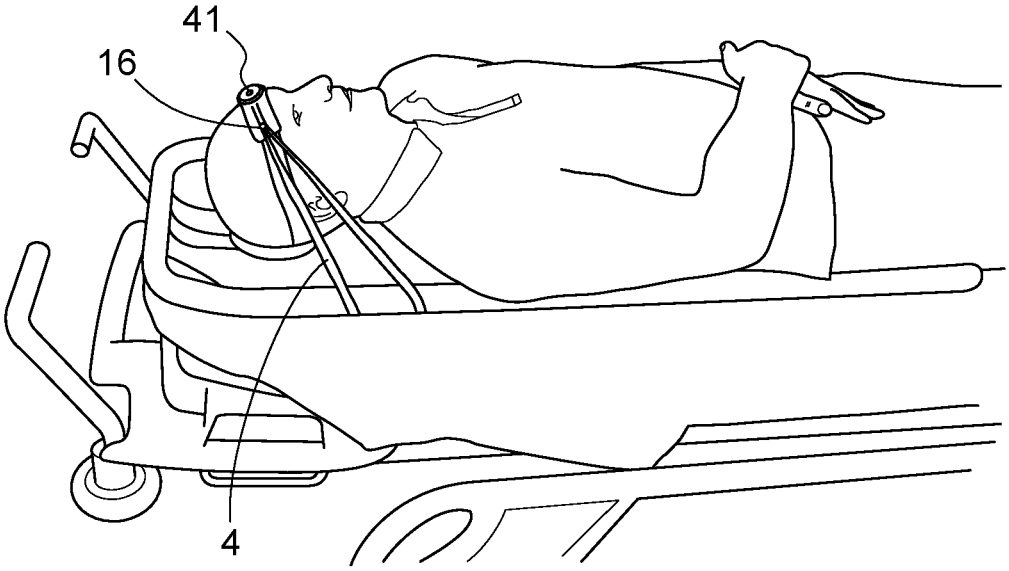
Figure 15B:
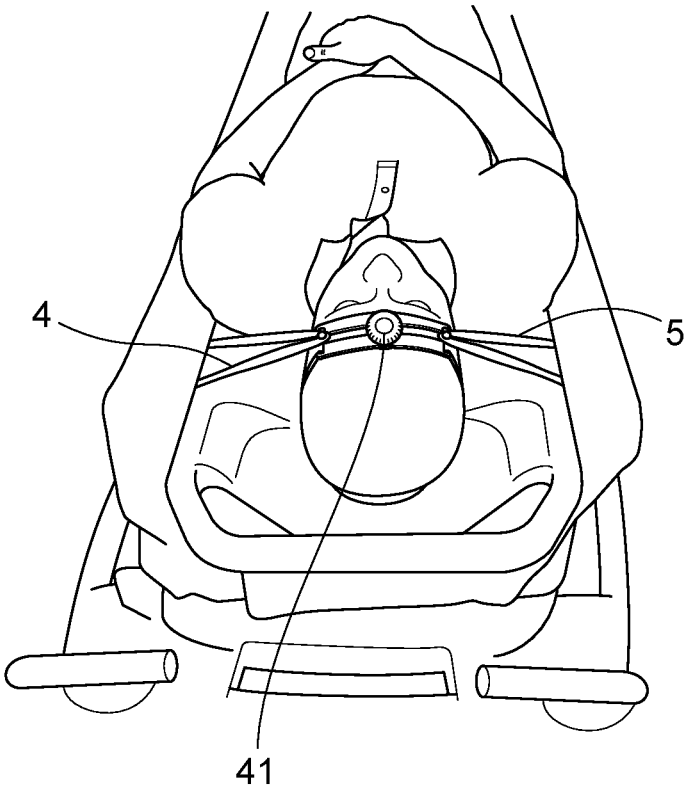

FIG. 4 provides a schematic representation of the head restraint of FIG. 3 being tightened;

FIG. 5 shows a schematic representation of the head restraint of FIGS. 3 and 4 with securement members attached, the adjustment unit being in the untensioned position;

FIG. 6 provides a close up of the head restraint of FIG. 5;

FIG. 7 shows a schematic representation of the head restraint of FIGS. 5 and 6, the adjustment unit being in the tensioned position;

FIG. 8 shows the head pad and head restraint of the embodiment of FIGS. 3 to 7;

FIG. 9 shows the patient restraint of the present invention as a kit of parts;

FIGS. 10*a*-10*i* provides schematic representations of the adjustment unit and the components thereof;

FIGS. 11*a*-11*d* provides schematic representations of the head pad;

FIG. 12 shows a securement member of the patient restraint of the present invention including a clip for securement to the support table;

FIG. 13 is a side view of a further embodiment of the head restraint of FIG. 1;

FIGS. 14A and 14B are views of the head restraint of FIG. 13 in combination with a further embodiment of the securement members of FIG. 2; and FIGS. 15A and 15B show a patient being restrained by the head restraint and securement members of FIGS. 14A and B.

The patient restraint, 1, of FIG. 1 includes a support table, 2, including handle openings therein, 3. Two securement members are provided, 4, 5, both of which are secured in handle openings, 3, of the support table 2. The patient is shown in FIG. 1, 10, and the securement members, 4, 5 are secured in handle openings, 3, of the support table 2 at a longitudinal position, 11, 12 above the patient's head and at a longitudinal position, 13, 14, below the patient's head. The securement members of FIG. 1, 4, 5, are shown prior to attachment to the head restraint. The head restraint is provided around the patient's head and an adjustment unit, 15, is attached to the head restraint and provided over the patient's forehead.

FIG. 2 shows the securement members, 4, 5 attached to the head restraint through attachment of the securement members to two affixments, 16, 17, on the adjustment unit, 15, The adjustment unit, 15, is shown in more detail in several subsequent Figures. FIG. 3 shows a substantially circular head pad, 20 to support the back of the patient's head in use. The head pad 20 is for placement on the support table, 2. The head pad, 20, includes a depression formed from concentric circular depressions. The head restraint 30 is in the form of strap 31 extending around the back of the head pad 20, and attached thereto at two positions off set from the centre of the head pad. Each end of the head restraint strap, 31, extends through a slit, 32, 33, in the adjustment unit 15. Each end of the head restraint strap, 31 doubles back on itself and is secured by means of a Velcro® fastening. As shown in FIG. 4, the head restraint and adjustment unit deform to the patient's head curvature. The adjustment unit, 15 includes a plate, 40, an adjustment mechanism in the form of a wheel, 41 and two affixments 16, 17 for attaching the securement members. FIG. 6 shows the affixments, 16, 17, in an untensioned position, and FIG. 7 shows them in a tensioned position. The affixments 16, 17 are in the form of a peg provided on a body, 42, 43 including teeth, 44, 45 at the side thereof facing the wheel 41. The wheel includes teeth, 46 which interlock with the teeth 44, 45. Movement of the wheel causes corresponding movement of the bodies 42, 43 including the affixments causing movement of the affixments between the tensioned and untensioned positions.

A further embodiment of the head restraint and securement members is illustrated in FIGS. 13 to 15.

In the previously-described embodiment the device is normally secured using cord with clips on either end which are fed through handle gaps and clipped back on themselves. In the present embodiment, these cords have been replaced by medical tape. 3M Durapore Surgical tape (2.5 cm width) is used, but other widths and types of tape are usable providing they have approximately comparable physical properties. Typically the tape is supplied with the head restrain device, but need not be.

In use, the tape is attached to the spinal board (by tying a knot, using appropriate adhesive, clips (50), clamps, and so on), and is looped around the pegs on the headpad and then attached back to the board (typically around 10 cm from the point of attachment of the other end of the tape, but other distances are possible). Thus a loop is formed around the pegs, with each side and each end of the tape being stuck to the board. In practice, the best arrangement was considered to have the tape secured in line with the top of the ear and in line with the shoulder on the board, and the same when securing to a bed. Thus in this embodiment the angle between the two lengths of tape on each end of the head restraint is approximately 20 degrees, but can of course be smaller or larger depending on the application, the patient, the bed or board, the properties of the tape, the method of affixing the tape to the board or bed, and so on.

By using tape instead of cord, the pegs on the headstrap are required to be modified slightly. The pegs of the first embodiment are typically shorter and have knurling (to stop slippage). The pegs of the present embodiment are slightly longer to better secure the thick tape, and the knurling is less (or not) needed, but can still be provided as desired and appropriate.

As before, the centre dial turns to bring the pegs closer together. This takes any slack out of the tape, either upon initial application or if the tape stretches.

Various modifications and variations of the described aspects of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes of carrying out the invention which are obvious to those skilled in the relevant fields are intended to be within the scope of the following Claims.

The invention claimed is:

1. A patient restraint assembly including:

a head restraint configured to extend around a patient's head, said head restraint including a first end configured to be positioned towards one side of the patient's head and a second end configured to be positioned towards the other side of the patient's head, at least one securement member extending from the first end of the head restraint, and at least one securement member extending from the second end of the head restraint, said securement members being configured to releasably secure said head restraint to a support table, and an adjustment unit to adjust the tension in the securement member(s), wherein adjustment of the adjustment unit applies a same force simultaneously to the securement member(s) at the first end and the securement member(s) at the second end of the head restraint.

2. The restraint assembly of claim 1 wherein each of the securement members is attached to the adjustment unit at an affixment, wherein the or each affixment is movable relative to the central lateral axis of the head restraint between a tensioned position and an untensioned position and movement from the untensioned position towards the tensioned position increases the tension in the securement members.

3. The restraint assembly of claim 2 wherein the adjustment unit includes more than one affixment, and all of the affixments are movable between the tensioned position and the untensioned position through adjustment of one mechanism.

4. The restraint assembly of claim 2 wherein the securement member(s) at the first end of the head restraint are attached to a first affixment, and the securement member(s) at the second end of the head restraint are attached to a second affixment, wherein movement of the first affixment and the second affixment from the untensioned position towards the tensioned position is effected through movement of the first affixment and the second affixment towards each other.

5. The restraint assembly of claim 1 wherein the securement member(s) extend from the first end of the head restraint in a first direction and in a second direction, said first and second directions separated by 5 to 120 degrees and the securement member(s) extend from the second end of the head restraint in a third and fourth direction, said third and fourth directions separated by 10 to 120 degrees.

6. The restraint assembly as claimed in claim 5 wherein the first and second directions are separated by 5 to 60 degrees; and the third and fourth directions are separated by 5 to 60 degrees.

7. The restraint assembly as claimed in claim 6 wherein the head restraint includes a first side, disposed between the first end and the second end and configured to face towards the top of the patient's head in use, and wherein the securement member(s) at the first end of the head restraint extend from the first end at an angle of more than 90 degrees from the plane intersecting the mid-point of the head restraint and the first side of the head restraint and the securement member(s) at the second end of the head restraint extend from the second end at an angle of more than 90 degrees from the plane intersecting the mid-point of the head restraint and the first side of the head restraint.

8. The restraint assembly of claim 5 including a first and second securement member, the first securement member extending from the first end of the head restraint in the first and second directions, and the second securement member extending from the second end of the head restraint in the third and fourth directions.

9. The restraint assembly of claim 6 wherein the head restraint is in the form of an elongate member configured to extend around at least 50% of the patient's head in use, the first direction is 95 to 120 degrees from the plane intersecting the mid-point of the head restraint and the first side of the head restraint, the second direction is 110 to 135 degrees from the plane intersecting the mid-point of the head restraint and the first side of the head restraint, the third direction is 230 to 250 degrees from the plane intersecting the mid-point of the head restraint and the first side of the head restraint, and the fourth direction, 240 to 265 degrees from the plane intersecting the mid-point of the head restraint and the first side of the head restraint.

10. The restraint assembly as claimed in claim 5 wherein the head restraint is in the form of an elongate member configured to extend around at least 50% of the patient's head in use, the first direction is 10 to 60 degrees from the longitudinal axis of the elongate member, the second direction is 300 to 350 degrees from the longitudinal axis of the elongate member, the third direction is 170 to 120 degrees from the longitudinal axis of the elongate member, and the fourth direction is 190 to 240 degrees from the longitudinal axis of the elongate member.

11. The restraint assembly of claim 1 wherein the head restraint is symmetrical across the central lateral axis of the head restraint.

12. The restraint assembly of claim 3 wherein each affixment is provided on a body, and each of the bodies and the mechanism comprises teeth, the teeth of the mechanism interlocking with the teeth of each of the bodies.

13. The restraint assembly of claim 3 wherein the mechanism is rotated to move the affixments between the tensioned and the untensioned position.

14. A kit of parts comprising the patient restraint assembly of claim 1 and instructions for use.

15. A patient restraint including:

a support table, a head restraint configured to extend around a patient's head, said head restraint including a first end configured to be positioned towards one side of the patient's head and a second end configured to be positioned towards the other side of the patient's head, at least one securement member extending from the first end of the head restraint, and at least one securement member extending from the second end of the head restraint, said securement members releasably securing said head restraint to the support table, and an adjustment unit to adjust the tension in the securement members, wherein adjustment of the adjustment unit applies a same force simultaneously to the securement member(s) at the first end and the securement member(s) at the second end of the head restraint.

16. The restraint as claimed in claim 15 wherein the securement member(s) at each of the first and second ends of the head restraint are releasably secured to the support table and the head restraint is at a longitudinal position on the support table between the positions at which the securement member(s) are releasably secured to the support table.

17. The restraint as claimed in claim 15 wherein the support table comprises a head end towards which the patient's head is configured to be provided during use, and a foot end, towards which the patient's feet are configured to be provided during use and wherein the head restraint is at a longitudinal position closer to the head end of the support table than the positions at which the securement members at each end of the head restraint are releasably secured to the support table.

18. A method of restraining a patient using the patient restraint of claim 15, the method comprising:

placing the patient on the support table;

extending the head restraint around the patient's head;

securing the head restraint to the support table using the securement member(s), said securement member(s) extending from the first side and the second side of the patient's head, generally in first, second, third and fourth directions; and adjusting the tension in the securement member(s) through adjustment of the adjustment unit.

19. A kit of parts comprising the patient restraint of claim 15 and instructions for use.

* * * * *